US005562161A

United States Patent [19]

Hisaw et al.

[11] Patent Number: 5,562,161

[45] Date of Patent: Oct. 8, 1996

[54] METHOD FOR ACCELERATING PRODUCTION

[76] Inventors: Jack C. Hisaw, 114 Froeba La., Carencro, La. 70520; Michael J. Gazewood, 402 Machine Loop, Scott, La. 70583

[21] Appl. No.: 429,863

[22] Filed: Apr. 27, 1995

[51] Int. Cl.[6] ..... E21B 43/00

[52] U.S. Cl. ..... 166/372; 166/68; 166/105

[58] Field of Search ..... 166/372, 369, 166/373, 370, 68, 105

[56] References Cited

U.S. PATENT DOCUMENTS

| | | | |
|---|---|---|---|
| 3,718,407 | 2/1973 | Newbrough | 417/108 |
| 4,390,061 | 6/1983 | Short | 166/53 |
| 4,603,735 | 8/1986 | Black | 166/372 X |
| 4,605,069 | 8/1986 | McClaflin et al. | 166/372 X |
| 4,726,420 | 2/1988 | Weeks | 166/372 X |
| 5,105,889 | 4/1992 | Misikov et al. | 166/372 |
| 5,302,286 | 4/1994 | Semprini et al. | 166/372 X |
| 5,374,163 | 12/1994 | Jaikaran | 166/68 X |
| 5,407,010 | 4/1995 | Herschberger | 166/372 |

OTHER PUBLICATIONS

"Jet Pumping," *The Technology of Artificial Lift Methods*, Hal Petrie, pp. 453–458.

"Jet Pumps," *Petroleum Engineering Handbook*, H. B. Bradley, pp. 6–34–6–43.

"Jet pump dewatering: What it is and how it works," *World Oil*, Edward A. Kampton and Robert G. Fisher, Nov., 1980; pp. 86–90.

Trico Industries, Inc., 1992–1993 Catalog.

*Primary Examiner*—Frank Tsay

*Attorney, Agent, or Firm*—C. Dean Domingue

[57] ABSTRACT

A method of increasing the production from a well completed to a reservoir is disclosed. Generally, the method comprises the steps of installing a venturi device within the well. A gas is injected within the annulus and introduced into the well. The venturi device creates a zone of low pressure within the well as well as accelerating the velocity of the production fluids so that the inflow from the reservoir is increased. In one embodiment, the venturi device is associated with a gas lift mandrel located in the well.

14 Claims, 7 Drawing Sheets

METHOD FOR ACCELERATING PRODUCTION

BACKGROUND OF THE INVENTION

The invention relates to a method of increasing production from a well. More particularly, but not by way of limitation, the invention relates to a method of injecting a gas or fluid into a well annulus in order to increase production from a reservoir.

Many times, in order to produce oil and gas, a well bore is drilled that will intersect a hydrocarbon bearing reservoir. The initial pressure of the reservoir will be quite substantial. The well will be completed to the reservoir, and thereafter, production may be commenced.

Reservoir fluids and gas will be produced during the life of the well. During the course of production, the reservoir will lose some of the pressure which makes it more difficult to lift the produced fluids and gas to the surface. While the reservoir may contain substantial reserves left to be produced, the inability to withdraw the hydrocarbons due to pressure depletion is a common problem faced by operators.

Numerous devices have been devised in order to overcome the problem of pressure depletion in the reservoir. One common method utilized by operators has been to install within the production tubing a series of gas lift mandrels. As is understood by those of ordinary skill in the art, a gas lift valve is introduced into the mandrel. The gas lift valve will allow gas that is placed into the annulus at a high pressure to be communicated with the inner diameter of the production tubing string.

Generally, gas lift is a method of lifting fluid where relatively high pressure gas is used as the lifting medium through a mechanical process. Two types of method are generally used. First, in continuous flow a continuous volume of high pressure gas is introduced into an eductor tube to aerate or lighten the fluid column until reduction of the bottom hole pressure will allow a sufficient differential across the sand face, causing the well to produce the desired rate of flow.

In order to accomplish this, a flow valve is used that will permit the deepest possible one point injection of available gas lift pressure in conjunction with a valve that will act as a changing or variable orifice to regulate gas injected at the surface depending upon tubing pressure.

The second method is referred-to as intermittent flow which involves the expansion of a high pressure gas ascending to a low-pressure outlet. A valve with a large port permits complete volume and pressure expansion control of gas entering into the tubing, thus either regulating lift of the accumulated fluid head above the valve with a maximum velocity to minimize slippage or controlling liquid fall back, fully ejecting it to the tank with minimum gas.

Jet pumps have also been utilized in oil and gas wells in order to produce low pressure wells. For instance, hydraulic jet pumps have been used as a down hole pump for artificial lift applications. An example of this type hydraulic pump is sold by Trico Industries, Inc. under the trade name "Kobe Hydraulic Jet Pumps".

In these types of hydraulic pumps, the pumping action is achieved through energy transfer between two moving streams of fluid. The power fluid at high pressure (low velocity) is converted to a low pressure (high velocity) jet by the nozzle. The pressure at the entrance of the throat becomes lower as the power fluid rate is increased, which is known as the venturi effect. When this pressure becomes lower than the pressure in the suction passageway, fluid is drawn in from the well bore. The suction fluid becomes entrained with the high velocity jet and the pumping action then begins. After mixing in the throat, the combined power fluid and suction fluid is slowed down by the diffuser. Because the velocity is reduced, the pressure increases-rising to a value sufficient to pump the fluid to the surface.

Despite these devices, there is a need for a device to create a zone of low pressure within a tubing and accelerate production from the production reservoir.

SUMMARY OF THE INVENTION

A method of producing a reservoir that is intersected by a casing string is described. The method comprising the steps of providing a tubing string within the casing and providing an aperture within the wall of the tubing string, with the aperture communicating the inner diameter and the outer diameter, with the outer diameter of the tubing string and casing forming an annulus. Next, the venturi device is lowered into the inner diameter of the tubing string at a position corresponding with the aperture.

The venturi device generally comprises a first section and a second section. The first section comprises the first section comprises means for accelerating velocity of the production fluids and creating a zone of low pressure within the inner diameter of the tubing string; lower seal means for sealing with the inner diameter of the tubing string. The second section comprises means for stinging into said seal means and an upper seal means for sealing with the inner diameter of the tubing;

Thus, the step of lowering the venturi device includes lowering on a wire line the first section so that the position of the first section is below the aperture. Then, setting the first section utilizing the setting means; and, lowering on the wire line the second section so that the position of the second section is stabbed into the first section. Then, setting a third section utilizing the anchor stop.

Once the venturi device has been positioned within the well, gas is injected into the annulus, and the gas is communicated from the annulus into the inner diameter of the tubing string through the venturi device.

The accelerating means generally comprises: a cylindrical chamber; a tube section, disposed within the cylindrical chamber and being partially concentric with the cylindrical chamber, with the tube section having a first end and a second end, with the tube being in communication with the aperture. The accelerating device also includes a nozzle disposed on the tube, with the nozzle being concentric with the cylindrical chamber and positioned to deliver the injected gas in the direction of flow of the reservoir fluids and gas.

Also included is a mixing chamber, operatively associated with the nozzle and extending from the cylindrical chamber; and a diffuser chamber that extends from the mixing chamber. Thus, the step of communicating the gas includes: passing the gas from the annulus through the aperture into the tube; exiting the gas at the nozzle; allowing the gas to mix with the reservoir fluids and gas in the mixing chamber; and, accelerating the velocity of the reservoir fluids and gas within the diffuser chamber.

In one embodiment, the step of injecting the gas into the annulus is for a predetermined time period, and the method further comprises the steps of terminating the injection of gas after the expiration of the predetermined time. Next, the operator measures the amount of time the injection is terminated, and after expiration of a predetermined amount of time, the gas injection is again activated. Also, the quantity of gas injection into the annulus may be varied in order to achieve the optimum production rates, depending on the circumstances and other variables such as nozzle size.

The operator may deem it advisable to change the nozzle size from time to time. Thus, the method would further include the steps of terminating the injection of gas; lowering into the tubing string a retrieving means for retrieving the three sections. The nozzle is replaced at the surface, placed back into the first section and the three sections are again lowered into the tubing string. The three sections are set into the inner diameter of the tubing as previously described.

Thereafter, the method further includes the steps of:

injecting a gas into the annulus and communicating the gas from the annulus into the inner diameter of the tubing string through the venturi device.

The aperture, which communicates the annulus to the venturi device, may be formed by a perforator means lowered into the well bore at some point during the life of the producing well. Alternatively, the well bore (when originally completed) could contain, within the tubing string, gas lift mandrels with a gas lift valve therein. The method would further include retrieving from the gas lift mandrel the valve means; and, placing within the gas lift mandrel a ported orifice valve means with back check valve. Thereafter, the venturi device may be installed as previously described.

A feature of the present invention includes use of a collar stop in order to locate the device in the tubing string and thereafter set the device within the inner diameter of the tubing string. Another feature of the present invention includes use of the anchor stop to hold down the first and second sections.

Yet another feature includes once the first and second section is set within the tubing, seal means for sealing within the inner diameter of the tubing is provided so that the injected gas and production stream is directed through the device for delivery to the surface. Still yet another feature consist of using a variable sized nozzles in order to achieve maximum efficiency of the venturi device. Another feature includes a replaceable throat and diffuser section that may also be replaced in order to achieve maximum efficiency.

Another feature includes use of a diverter tube that diverts the injected gas into the device. Still yet another feature is the use of a remedial work string, such as wire line, to set the device within the tubing string.

An advantage of the present invention includes that there are no moving parts within the venturi section. Another advantage is that the device is compact and can be placed within the inner diameter of tubing strings.

Another advantage is that the venturi device creates an area of low pressure within tubing string. Still yet another advantage is that the reservoir fluids will be entrained with the injected gas thereby lifting the fluids to the surface. Another advantage is that the design directs the injected gas away from the reservoir and towards the surface so that the injected gas does not expand downward.

Yet another advantage includes that in the throat, the injected gas and produced fluid mix, and momentum is transferred from the injected gas to the produced fluid, causing an energy rise in the produced fluid. Once the produced fluid and injected gas travel through the throat, the mixed fluid enters an expanding area diffuser that converts the remaining kinetic energy to static pressure by slowing down the fluid velocity. The pressure in the fluid is now sufficient to flow the reservoir fluids and gas to the surface.

In one embodiment herein disclosed, the device may be installed in wells with gas lift mandrels already within the tubing string. Still yet another advantage is that in wells without no gas lift mandrels, a perforation may be formed through the tubing and the invention may be utilized. Another advantage is that the embodiments herein described may be removed from the inner diameter of the tubing strings without obstructing the inner diameter. Still yet another advantage is that the nozzle and throat sections may be replaced with more efficient sizes. Yet another advantage is that the device may be used as an intermittent lift system in order to unload wells such as unloading water from gas wells.

BRIEF DESCRIPTION OF THE PREFERRED EMBODIMENTS

DETAILED DESCRIPTION OF THE PREFERRED EMBODIMENT

Figure 1:
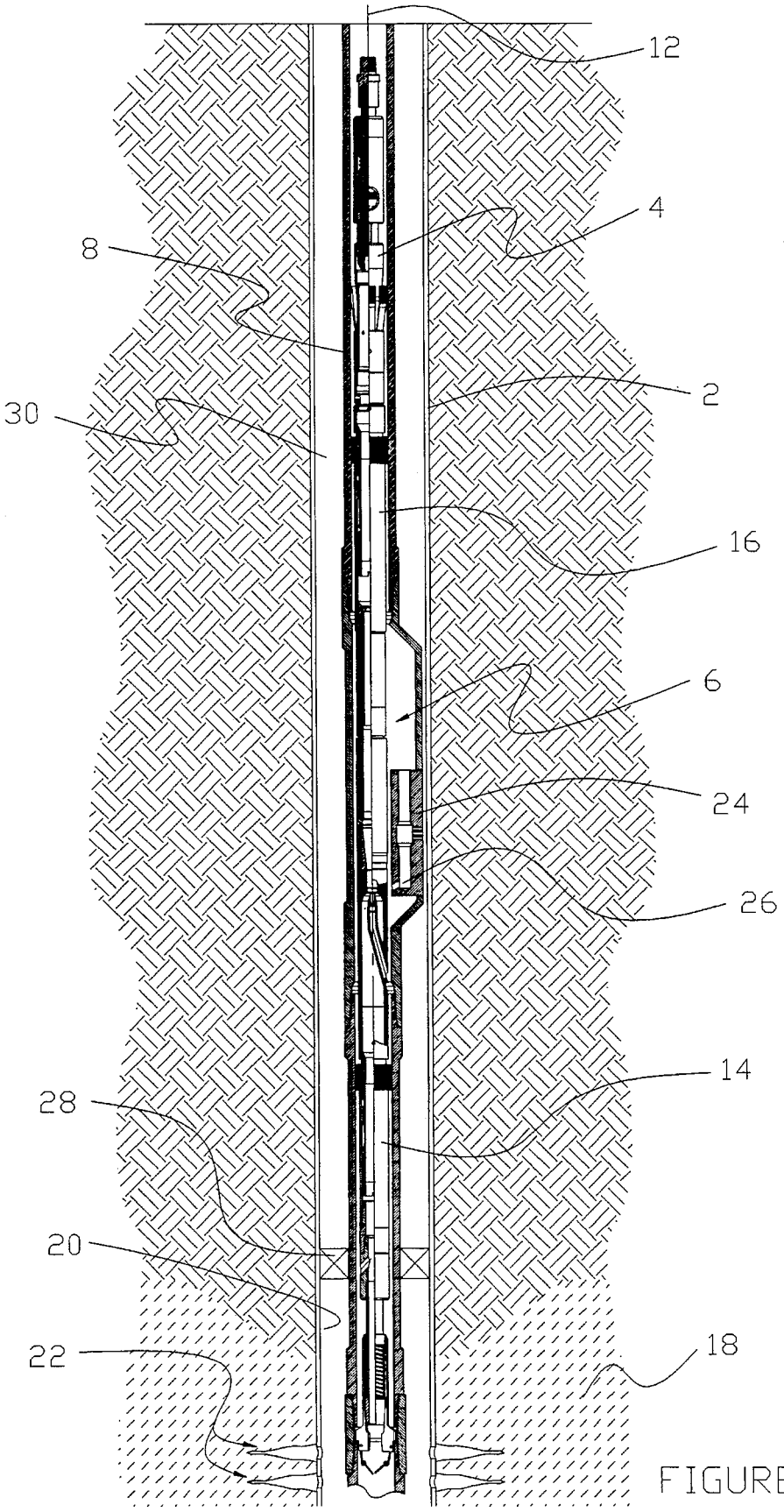
FIG. 1 is a schematic of a typical well bore with the third section of the invention being positioned within the tubing string by means of a wire line unit.

Referring now to FIG. 1, a typical well bore 2 with the third section 4 of the invention 6 being positioned within the tubing string 8 by means of a wire line unit (not shown) having a wire line 12 extending therefrom is shown. As seen in FIG. 1, the first section 14 and the second section 16 of the invention would have already placed within the tubing string 8, and the third section is being positioned within the tubing string 8, as will be more fully explained hereinafter.

The well bore 2 is generally a casing string that intersects various subterranean reservoirs. Some of the reservoirs will contain commercial deposits of hydrocarbons. The well bore 2 will be completed to the reservoir 18 with the reservoir's fluid and gas being produced into the lower annulus 20 through the perforations 22.

FIG. 1 also depicts a tubing string 8 that has disposed thereon a gas lift mandrel 24 that has a side pocket for the placement of a gas lift valve. In the embodiment shown in FIG. 1, the gas lift valve has been removed and in its place has been placed a ported valve 26. The ported valve 26 was placed within the side pocket using traditional wire line methods, as is understood by those of ordinary skill in the art.

A packer means 28, operatively associated with the tubing string 8, for sealingly engaging the tubing string 8 with the casing 2 so that an upper annulus 30 and the lower annulus 20 is formed. It should be noted that like numbers in the various figures of the application refer to like components.

Figure 2A:
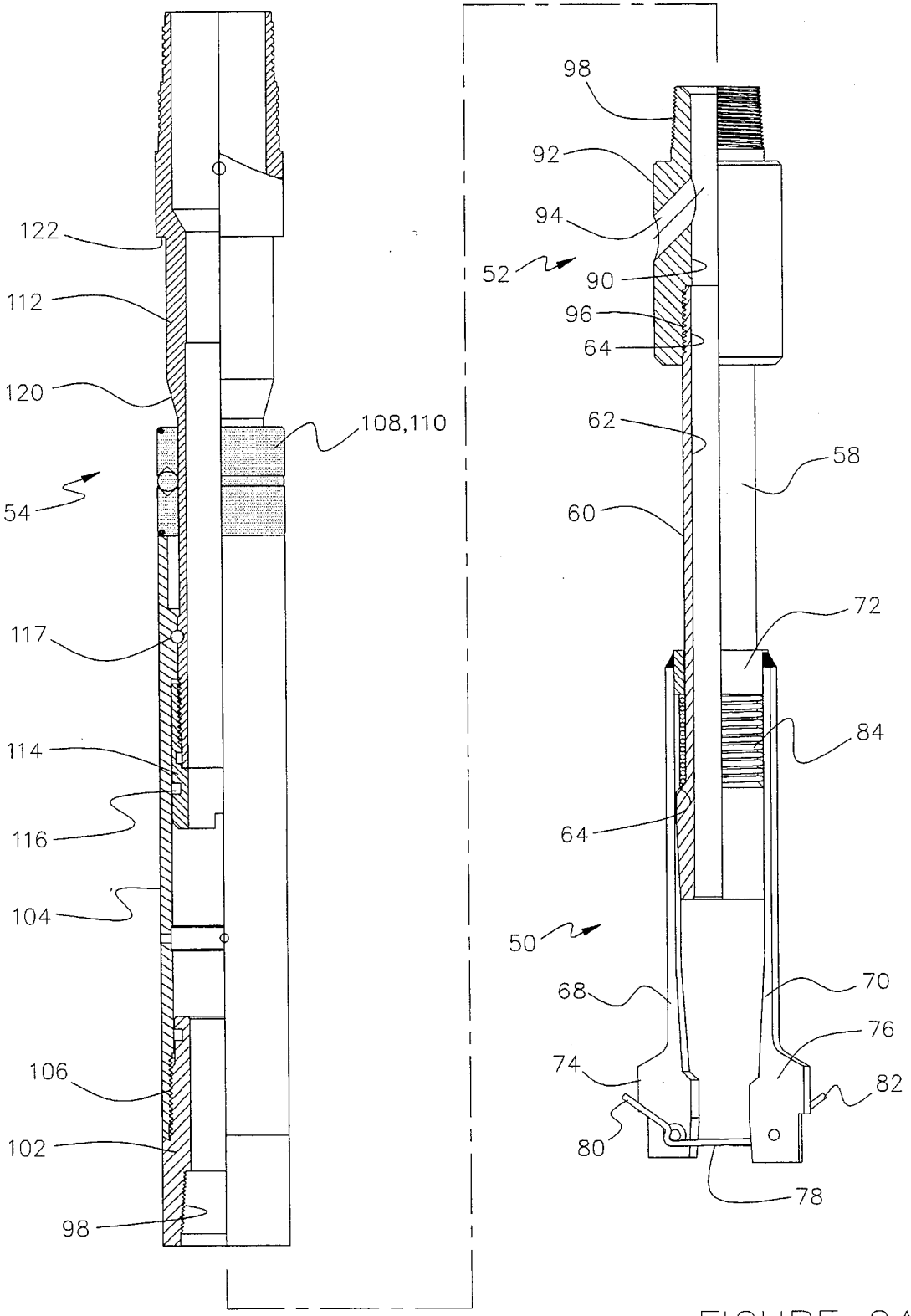
FIGS. 2A–2B are an enlarged partial sectional view of the first section of the invention that is positioned within the tubing string.
Figure 2B:
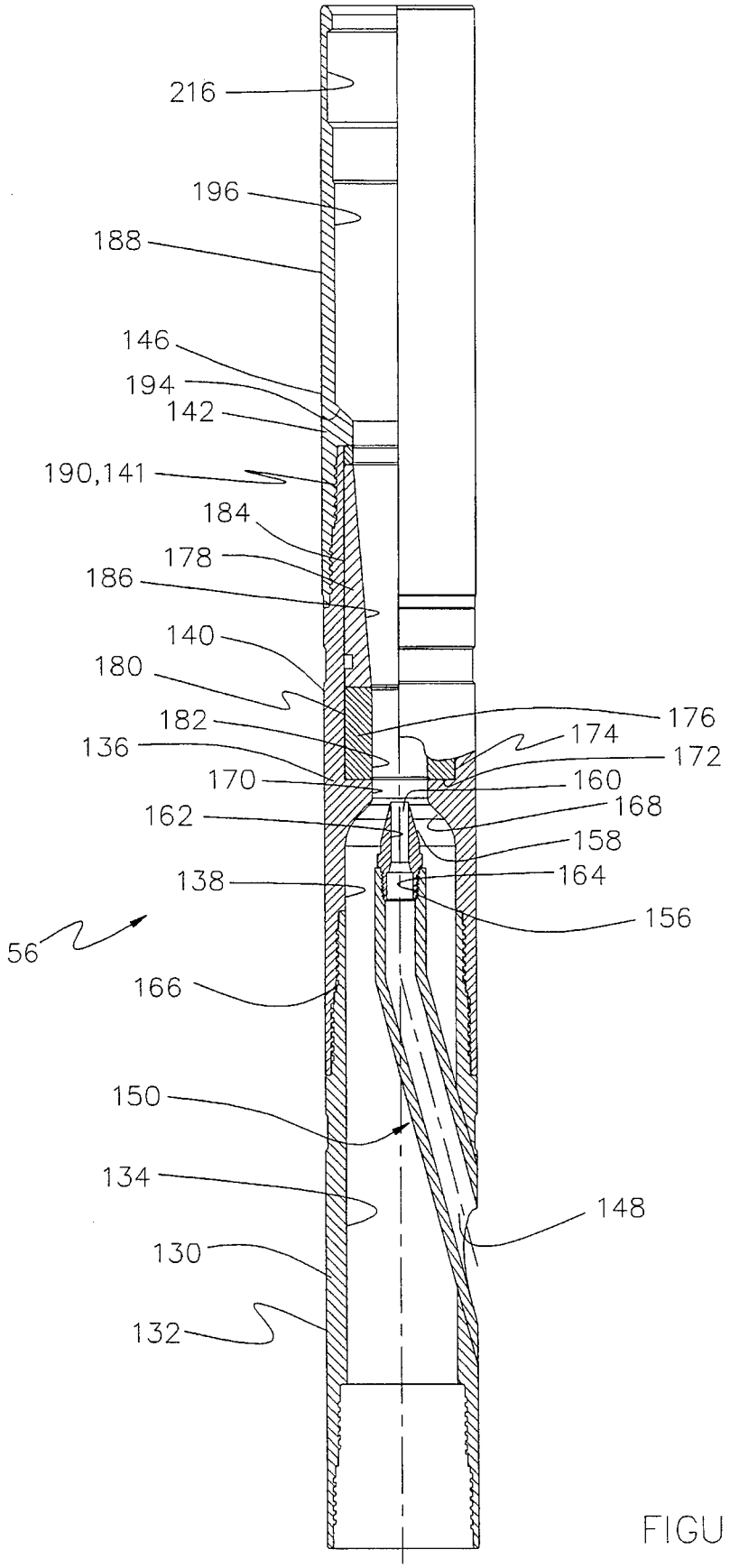

Referring now to FIGS. 2A–2B, an enlarged partial sectional view of the first section of the invention that is positioned within the tubing string is illustrated. Generally, the first section comprises the components of a spring loaded collar stop means 50 for locating in a collar, a lower flow sub 52 means for allowing the flow of the reservoir's 18 fluids and gas, a lower sealing means 54 for sealingly engaging the inner diameter of the tubing string 8, and the venturi means 56 for increasing the velocity of the reservoir fluids and creating a zone of low pressure within the inner diameter of the tubing string 8.

The spring loaded collar stop means 50 includes a mandrel 58 having an outer surface 60 and an inner surface 62. The outer surface 60 of the mandrel 58 will have on one end the external thread means 64, while on the opposite end the surface 60 has a shoulder 66. The spring loaded collar stop means 50 also includes a first arm 68 and second arm 70 that has one end attached to a ring member 72, with the ring member being disposed about the mandrel 58. The second end of the arms 68, 70 contains a protuberances 74, 76 respectively, for engagement into a collar recess, that will be explained in greater detail later in the application. The protuberances 74, 76 are axially held together by the springs 78, with the spring having a first prong 80 and a second prong 82 for catching the collar recess. Due to the shape of the arms 68, 70, when held together by the spring 78 (as shown in FIG. 2), the arms 68, 70 can not travel axially upward on the mandrel 58. Disposed about the outer surface 60 is the spring means 84 for biasing the ring member 72 axially upward. The spring means 84 will be in compression as long as the spring 80 is not tripped.

The collar stop 50 is attached to the flow sub means 52. The flow sub means 52 generally comprises an inner diameter surface 90 and an outer diameter surface 92. The flow sub 52 will contain a flow port 94 which communicates the flow from the reservoir 18 with the inner diameter of the flow sub means 52. The flow sub means 52 will have internal thread means 96 that engage with the thread means 64, as well as the external thread means 98.

The lower sealing means 54 is connected to the flow sub 52. Normally, the lower sealing means 54 will comprise a first adapter 102 that is connected to a housing member 104. The housing member 104 will have a first end 106 that is connected to the adapter 102. The second end 108 will have disposed thereon a seal means 110 for sealingly engaging the inner diameter of the tubing string 8.

An inner setting mandrel 112 is disposed within the housing member 104. As depicted in FIG. 2, the inner mandrel 112 has attached thereto a sub member 114 that has contained thereon the seal means 116 for sealingly engaging the inner diameter of the housing member 104. The upper seal means 110 will have a shear pin member 117 that selectively attaches the housing 104 and inner mandrel 112 together. The outer diameter 118 of the inner mandrel 112 has a chamfered surface 120 that ultimately extends to the shoulder 122. The inner mandrel 112 will then be attached to the venturi means 56 via the external thread means 124.

The venturi means 56 includes a first housing 130 that has an outer diameter 132 and an inner diameter 134. The venturi means 56 will have a second housing 136 that is attached to the first housing 130, with the second housing having an inner diameter 138 and an outer diameter 140, with the outer diameter extending to the external threads 141. The venturi means 56 also has a third housing 142 attached to the second housing, with the third housing 142 having an inner diameter 144 and an outer diameter 146.

The first housing 130 will contain a flow port 148, with a flow tube diverter means 150 for diverting the flow of an injected gas from the annulus area 30 into the inner diameter of the invention, as will be explained later in the application. Basically, the flow tube diverter means 150 includes a cylindrical member 152 that extends from the flow port 148. The flow tube diverter means 150 extends into the inner diameter of the invention in a direction that directs the flow of high pressure natural gas upward relative to the perforations 22. In other words, the tube diverter means 150 directs the flow of natural gas toward the surface relative to the perforations 22.

Attached at one end of the flow tube diverter means 150 will be the replaceable nozzle means 154. Generally, the nozzle means is threadedly attached to the tube diverter means 150 by external threads 156. The external thread means 156 extend to a chamfered outer surface 158 that concludes at the nozzle opening diameter 160. Extending radially inward of the opening 160 is the inner diameter surface 162 that in turn extends to an expanded inner diameter surface 164.

The second housing 136 will contain at one end internal thread means 166 that will threadedly engage the first housing. The inner diameter surface 138 narrows, as seen at 168, and concludes at the inner bore surface 170. Thus, the surfaces 138, 168 and 170 form the entry to the throat section of the venturi means. The inner bore surface 170 concludes at the radial shoulder 172 which in turn extends to the inner surface 174.

The second housing 136 has contained therein the replaceable throat section 176 which abuts the replaceable diffuser section 178. Generally, the throat section 176 will have an outer cylindrical surface 180 that is disposed within the inner surface 74, and the throat section 176 will have an inner diameter bore 182. The ratio of the inner diameter bore 182 relative to the nozzle opening diameter 160 is an important factor in designing the amount of velocity and pressure amounts required, as will be described later in the application.

The diffuser section 178 will have an outer cylindrical surface 184 with a groove for placement of a seal means, with the outer cylindrical surface 184 being disposed within the inner surface 174. Extending radially inward is the expanding inner bore surface 186. The ratio of the expanding inner bore surface 186 to the nozzle opening and throat inner diameter is also an important factor in designing the amount of velocity and pressure amounts require, as will be described later in the application. As can be seen in FIG. 2, the diameter is expanding in the normal direction of flow.

The third housing 142 will have an outer surface 188 that extends to one end that has thread means 190 (which engage with the thread means 141) while on the other end is the fishing neck profile 192. Extending radially inward, the third housing will have a chamfered shoulder 194 which in turn extends to the internal bore surface 196, which in the preferred embodiment is a polished bore receptacle.

Figure 3:
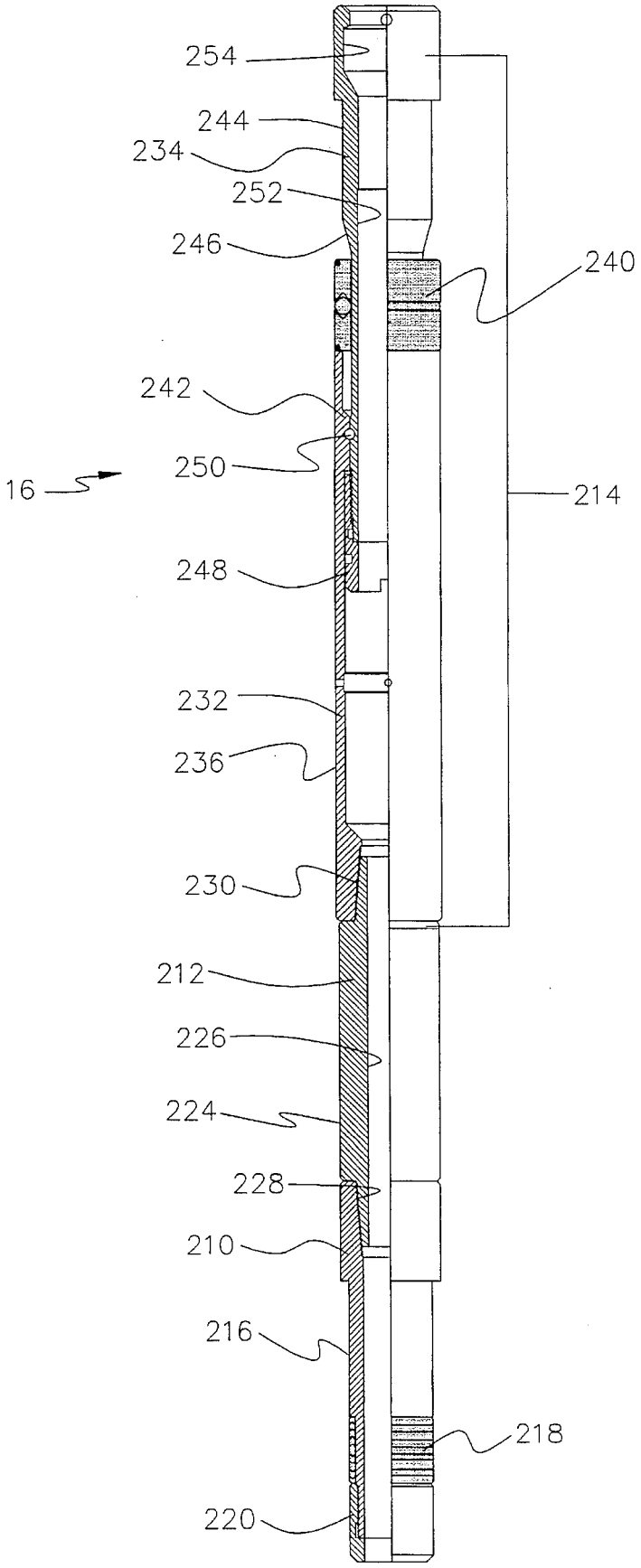
FIG. 3 is an enlarged partial sectional view of the second section of the invention that is positioned within the tubing string.

Referring now to FIG. 3, the second section 16 which is run into the well bore 2 will now be described. Generally, the second section comprises a stinger assembly 210, a spacer pipe 212, and an upper seal means (also known as a pack off) 214 which is similar in design to the lower seal means 54. The stinger assembly 210 has an outer cylindrical surface 216 that has contained thereon a set of seal means 218, with the seal means ending at the bottom sub 220. The seal means 218 will cooperate with the polished bore receptacle 196 so that a seal is established once the second section 16 is run into and stung into the first section 14. Extending radially inward is the internal surface 222.

The spacer pipe 212 has an outer surface 224 and an inner surface 226, with the spacer pipe 212 being attached at one end via thread means 228 to the stinger assembly 210, and with thread means 230 to the upper pack off 214.

The upper seal means (also known as the pack off) 214 generally includes a housing member 232 and an inner setting mandrel 234 that cooperates therewith. The housing member 232 will contain an outer surface 236 that has at one end thread means 238 for threadedly attaching to the spacer pipe 212 and at the other end seal means 240 for sealingly engaging the inner diameter of the production string 8. The inner diameter of housing member 232 will have a shoulder 242.

The inner mandrel 234, which is similar in design to the inner mandrel 112 of the lower seal means 54, is disposed within the housing 232. The inner mandrel 234 will contain an outer cylindrical surface 244 that concludes to a chamfered surface 246 which in turn extends to the sub member 248. The upper seal means 214 will have a shear pin member 250 that selectively attaches the housing 232 and inner mandrel 234 together. The internal diameter 252 of the inner mandrel 234 extends to the fishing neck profile 254.

Figure 4:
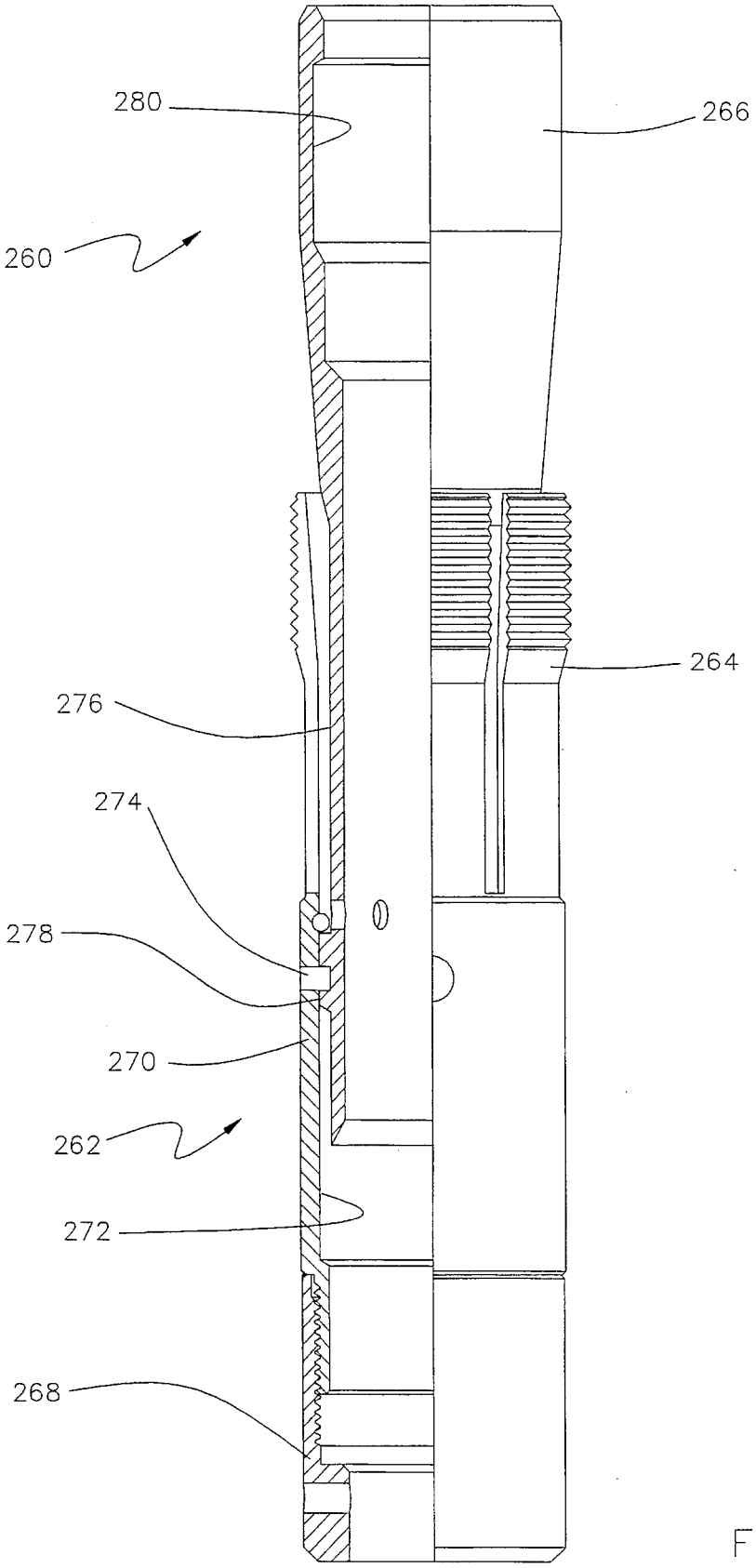
FIG. 4 is an enlarged partial sectional view of the third section of the invention that is positioned within the tubing string.

Referring now to FIG. 4, an anchor apparatus 260 known to those of ordinary skill in the art as a "G-Stop" will now be described. The G-Stop contains a housing 262, a slip means 264 operatively associated therewith, and a setting mandrel 266. The housing may have a first cylindrical section 268 and a second cylindrical section 270, with the first and second section being threadedly connected. The inner bore 272 of the second section will disposed within the setting mandrel 266, with the setting mandrel 266 being attached to the second section by means of a shear pin 274.

The setting mandrel 266 comprises an outer surface 276 that has disposed thereon a shoulder 278, with the surface 276 generally increasing in outer diameter. Extending radially inward is the fishing neck 280. The slip means 264 are operatively connected to the housing 262 and are operatively associated with the setting mandrel 266 for engagement with the inner diameter of the tubing string 8.

Figure 5:
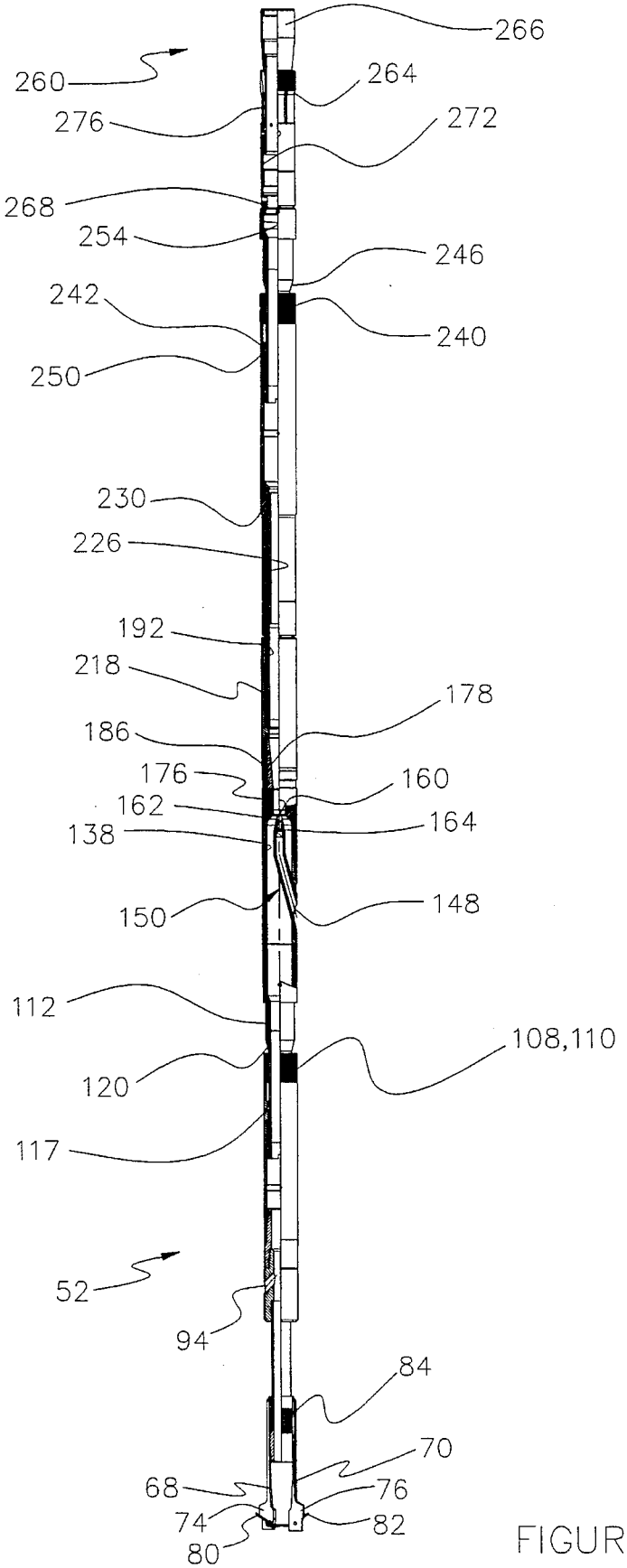
FIG. 5 is an enlarged partial sectional view of the first, second, and third sections assembled in tandem.

The first section 14, second section 16, and third section 260 are individually run into the tubing string 8 by means of a "GS" Pulling Tool (not shown) that is well understood by those of ordinary skill in the art. A "GS" Pulling Tool is commercially available from Specialty Machine & Supply, Inc. The sequence of running into the tubing string 8, as well as pulling out of the tubing string 8, will be described herein after. With reference to FIG. 5, the assembled invention is shown before any of the various components have been set within the inner diameter of the tubing string 8.

Figure 6:
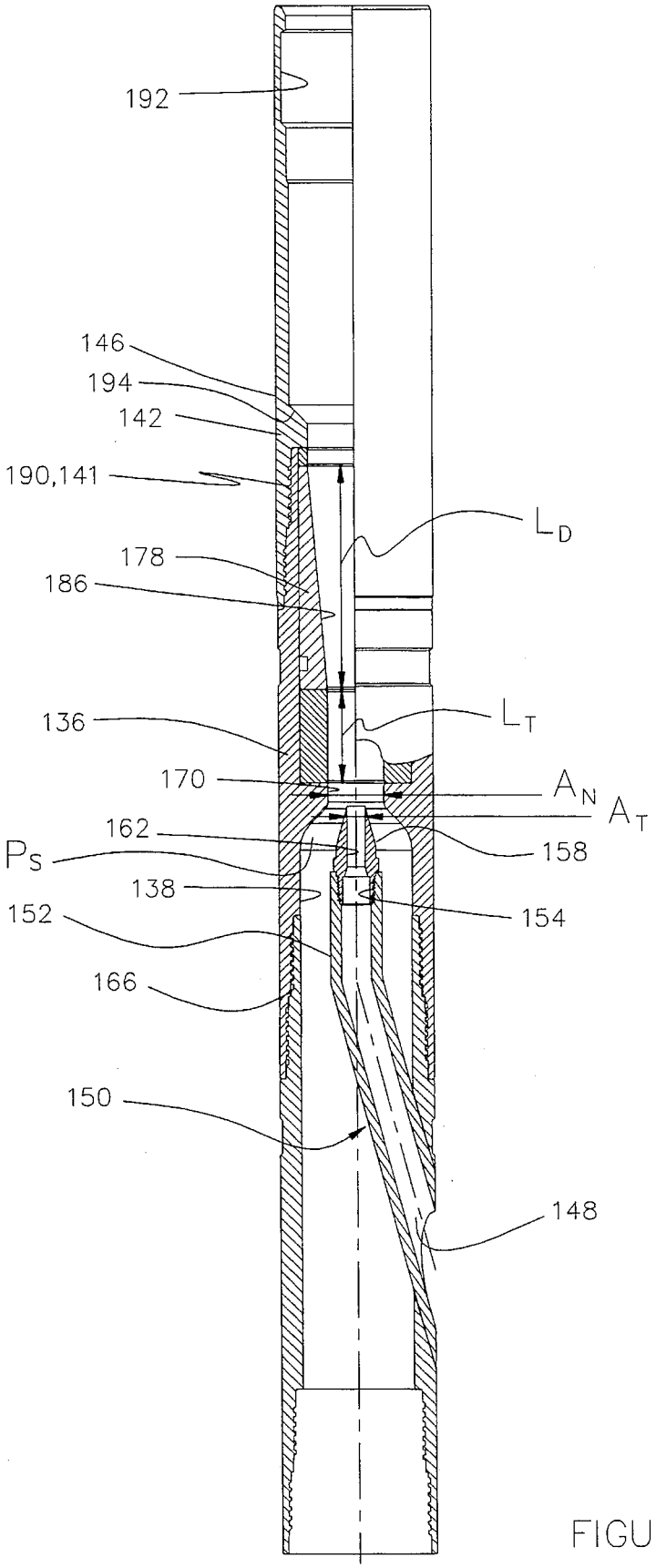
FIG. 6 is an enlarged sectional view of the venturi means of the present invention.

Referring now to FIG. 6, an enlarged view of the venturi means 56 will be discussed. The nozzle opening 160 will have an area An. The inner bore 182 throat will have an area At which is greater than the area An. Further, the length Lt of the throat section 176, as well as the length Ld will have effects as to the pressure and velocity profiles of the injected gas and the produced reservoir fluids.

OPERATION:

In order to utilize the invention 6 herein described, the operator will position the first section 14 into the tubing string 8. In the embodiment herein described, the tubing string has a gas lift mandrel 24 even though the invention 6 is applicable to tubing strings that do not contain gas lift mandrels. The sections may be lowered via a wire line 12. Other remedial work strings, such as coiled tubing, are available to set these devices.

The bottom hole assembly will generally comprise the spring loaded collar stop means 50, lower flow sub means 52, and venturi means 56 as shown in FIG. 2. The bottom hole assembly will be connected to a "GS" Running Tool which is commercially available from Specialty Machine & Supply, Inc. The procedure for setting includes lowering the wire line 12 and allowing the prongs 80, 82 of the spring 78 to be lowered through the collars contained on the tubing strings. Once the operators is at the proper depth, the bottom hole assembly is lifted so that the prongs 80, 82 catch in the collar. Once the prongs 80, 82 catch in the collar, the springs 78 will be undone thereby allowing the arms 68 and 70 to expand as well as releasing the spring 84. The arms 68, 70 (and in particular the protuberances 74, 78) will be held within the collar and allow an anchor for setting the lower seal means 54 (as seen in FIG. 1).

Next, the setting of the lower seal means is achieved by jarring down on the bottom hole assembly in a conventional manner. The jarring down will allow the chamfered surface 120 of the inner mandrel 112 to shear the pin 117 so that the mandrel 112 moves down; the housing member 104, however, has been held stationary, and thus, the chamfered surface 120 expands the seal means 110 as is understood by those of ordinary skill in the art.

The operator will then pull out of the tubing string 8 with the "GS" Running Tool. The second section 16 (as seen in FIG. 3) is then assembled, which comprises the stinger assembly 210, spacer pipe 212, and the upper pack off 214. The second section 16 is positioned within the tubing string via the wire line 12 and is run into the tubing 8 with the "GS" Running Tool. The stinger assembly 210, and in particular the seal means 218, will locate into the polished bore receptacle 196 and will abut chamfered shoulder 194.

The second section 16 is set in a similar manner as the first section 14 in that the bottom hole assembly is jarred down which in turn will cause the inner setting mandrel 234 to move down relative to the stationary housing member 232. The shear pin 250 is sheared after the appropriate force has been applied via jarring. The chamfered surface 246 will cause the seal means 240 to expand into sealingly engagement with the inner tubing sting 8.

The operator will then pull out of the tubing string 8 with the "GS" Running Tool. The third section 260 (as seen in FIG. 4 and referred to as the "G-Stop") is then lowered via the wire line 12. The G-Stop 260 is set by jarring down on the top portion of the setting mandrel 266 so that the shear pin 274 is sheared. The setting mandrel 266 moves down relative to the stationary housing 262 so that the slip means 264 expand (due to the chamfered surface of the setting mandrel 266) into the inner diameter of the tubing string 8. The assembled invention as set across the gas lift mandrel is seen in FIG. 1.

In order to increase production from the reservoir 18, the operator will accelerate velocity of the reservoir's 18 hydrocarbons within the invention as well as creating a zone of low pressure within the invention. This is done by injecting a high pressure gas from the surface into the upper annulus 30. The gas will exit at the nozzle 154, and in particular, the nozzle opening 160 .

Referring now to FIG. 6, the pressure/velocity transfer is achieved through energy transfer between the high pressure injection gas and the production reservoir fluids. The power gas at high pressure (low velocity) is converted to a low pressure (high velocity) jet by the nozzle 154. The pressure at the entrance of the throat 176 becomes lower as the power gas rate is increased, which is known as the venturi effect. When this pressure becomes lower than the pressure in the suction passageway (Ps), fluid is drawn in from the area below the flow tube diverter 150. The suction fluid (reservoir 18 fluid) becomes entrained with the high velocity jet and the pumping action then begins. After mixing in the throat 176, the combined power gas and suction fluid is slowed down within the diffuser 178. Because the velocity of this mixed stream (power gas and suction fluid) is reduced, the pressure increases within the diffuser 178-rising to a value sufficient to pump the fluid to the surface.

In one embodiment, the injection of the power gas is initiated for a predetermined amount of time. After expiration of a predetermined amount of time, the power gas injection is then terminated, again for a predetermined time period in order to unload the well. This sequence may be repeated as many times as desired by the operator. Further, the amount of time of injection as well as shut-in may be varied in order to obtain maximum production efficiency.

During the life of the reservoir 18, the operator may deem it appropriate to change the nozzle 154, throat 176, and/or the diffuser section 178 in order to optimize production. The method would then comprise the steps of retrieving the "G-Stop" by running in the tubing second with a "GS Pulling Tool", and engaging in the fishing neck, as is well understood by those of ordinary skill in the art, and pulling out of the tubing 8 with the G-Stop. Next, the GS Pulling Tool is again run into the tubing 8 and the second section 16 is pulled by engaging into the fishing neck 254. The second section is then retrieved from the tubing 8.

The third section is then pulled out of the tubing 8 in a similar manner using a "GS" Pulling Tool.

At the surface, the operator may then replace the nozzle 154 with a second nozzle of different size. The purposes of replacing the nozzle may be to substitute for a different size, or alternatively, to replace a damaged nozzle. Other components of the first section 14 may also be replaced.

Generally, the area of the nozzle (An) for a venturi device in relation to the area of the throat (At) is an important design consideration (as seen in FIG. 7). Further, the length of the throat (Lt) in relation to the length of the diffuser (Ld) is another important design consideration as well as the length of the throat in relation to the inside diameter of the throat. Thus, the operator may change out individual components or may wish to substitute another second section.

After replacing the necessary components, the operator may the lower into the tubing 8 on wire line 12 and replace the first section 14. The other components of the first section remain the same, namely the spring loaded collar stop means 50, the lower flow sub means 52, the lower sealing means 54, and venturi means 56. The first section is lowered and set as described earlier.

The second section 16, which includes a stinger assembly 210, a spacer pipe 212, and an upper seal means (also known as a pack off) 214 which is similar in design to the lower seal means 54. The second section will be lowered and set as described earlier. Finally, the G-Stop 260 will be lowered and set as described earlier.

Changes and modifications in the specifically described embodiments can be carried out without departing from the scope of the invention which is intended to be limited only by the scope of the appended claims.

We claim:

1. A method of increasing production from a well completed to a reservoir comprising the steps of:

installing a venturi device within the well and wherein said well has contained therein a gas lift mandrel with a valve positioned therein and wherein said venturi device is adapted within said gas lift mandrel, and the method of installing said venturi device includes:

retrieving said valve from said gas lift mandrel;

installing a ported valve within said gas lift mandrel;

flowing the well;

creating a zone of low pressure within the well;

increasing an inflow from the reservoir.

2. The method of claim 1 wherein said step of installing said venturi device further comprises:

installing a first section of said venturi device positioned below said gas lift mandrel;

installing a second section of said venturi device positioned above said gas lift mandrel.

3. The method of claim 2 wherein said first section of said venturi device comprises a setting tool means, a collar stop means, a lower pack off assembly means, a polished bore receptacle and a venturi means, and wherein the step of installing the first section includes:

lowering into the well on wire line the first section;

locating the position of the first section;

jarring down on the first section and setting the first section within the well.

4. The method of claim 3 wherein said second section comprises a stinger assembly, upper pack off means, and wherein the step of installing the second section includes:

lowering into the well on wire line the second section;

stinging said stinger assembly into said polished bore receptacle of said first section;

jarring down on the second section and setting the upper pack off means.

5. The method of claim 4 wherein said venturi means comprises: a mandrel with a port therein; a nozzle, operatively connected with said mandrel port, said nozzle being directed in a parallel orientation relative to the flow profile; a mixing chamber portion, operatively associated with the nozzle; and a diffuser chamber, operatively associated with the mixing chamber portion; and wherein the step of creating a zone of low pressure within the well comprises:

injecting a gas into an annulus;

exiting the gas at said nozzle;

mixing the gas and liquid from the reservoir in the mixing chamber;

delivering the mixed gas and liquid to the diffuser chamber.

6. The method of claim 5 wherein said step of injecting the gas into the annulus comprises the steps of:

initiating the injection of the gas for a first predetermined amount of time;

terminating the gas injection for a second predetermined amount of time;

initiating the injecting of the gas after the lapse of the second predetermined amount of time;

unloading the fluid within the well.

7. The method of claim 6 further comprising the steps of:

retrieving the second section from the tubing string;

replacing said nozzle with a second nozzle;

lowering into the well on wire line the second section with the second nozzle;

locating the position for setting the second section;

jarring down on the second section and stinging said stinger assembly into said polished bore receptacle.

8. A method of producing a reservoir that is intersected by a casing string, the method comprising the steps of:

providing a tubing string within the casing;

providing an aperture within the wall of the tubing string, with the aperture communicating the internal diameter of the tubing string and the outer diameter, with the external diameter of the tubing string and casing forming an annulus;

lowering a venturi device into the internal diameter of the tubing string at a position corresponding with said aperture, and wherein said venturi device comprises a first section and a second section and wherein:

the first section comprises:

means for accelerating velocity of the production fluids and creating a zone of low pressure within the internal diameter of the tubing string; lower seal means adapted to said accelerating means, for sealing with the internal diameter of the tubing string;

the second section comprises:

means for stinging into said seal means and an upper seal means for sealing with the internal diameter of the tubing;

and wherein the step of lowering said venturi device includes:

lowering on a wire line the first section of said venturi device so that the position of the first section is below the aperture;

setting said first section utilizing the setting means;

lowering on the wire line the second section of said venturi device so that said stinging means is placed into said lower seal means;

injecting a gas into the annulus;

communicating-the gas from the annulus into the internal diameter of the tubing string through said venturi device.

9. The method of claim 8 wherein said accelerating means comprises:

a cylindrical chamber; a tube section, disposed within said cylindrical chamber and being partially concentric with said cylindrical chamber, with said tube section having a first end and a second end, with said first end being in communication with the aperture; a nozzle disposed on said second end of said tube, with said nozzle being concentric with said cylindrical chamber and positioned to deliver the injected gas in the direction of flow of the reservoir fluids and gas; a mixing chamber, operatively associated with said nozzle and extending from said cylindrical chamber; and a diffuser chamber, operatively associated with said mixing chamber and extending from said mixing chamber;

and, wherein the step of communicating the gas includes:

delivering the gas from the annulus through the aperture into the tube;

exiting the gas at the nozzle;

allowing the gas to mix with the reservoir fluids in the mixing chamber;

accelerating the velocity of the reservoir fluids and gas within the diffuser chamber.

10. The method of claim 9 wherein the step of injecting the gas into the annulus is for a predetermined time, and the method further comprises the steps of:

terminating the injection after the expiration of the predetermined time;

measuring the amount of time the injection is terminated;

activating the injection after expiration of a predetermined amount of time.

11. The method of claim 10 further including the steps of:

terminating the injection of gas;

lowering into the tubing string a retrieving means for retrieving said second section;

retrieving said first and second section;

replacing the nozzle;

lowering into the tubing string said first and second section;

setting said first and second section.

12. The method of claim 11 further including the steps of:

injecting a gas into the annulus;

communicating the gas from the annulus into the internal diameter of the tubing string through said venturi device.

13. The method of claim 12 wherein the step of providing an aperture includes:

lowering into the tubing string a perforator means for perforating an opening in the wall of the tubing string.

14. The method of 12 wherein the step of providing an aperture includes:

providing within the tubing string a gas lift mandrel with a gas lift valve;

retrieving from the gas lift mandrel the gas lift valve;

placing within the gas lift mandrel a ported valve means for preventing communication between the annulus and the internal diameter of the tubing string.

* * * * *